United States Patent [19]

Hage

[11] 4,133,153

[45] Jan. 9, 1979

[54] PARTITION RACEWAY

[75] Inventor: C. Herbert Hage, Poland, Ohio

[73] Assignee: GF Business Equipment, Inc., Youngstown, Ohio

[21] Appl. No.: 779,848

[22] Filed: Mar. 21, 1977

[51] Int. Cl.[2] ..... E04B 5/48

[52] U.S. Cl. ..... 52/220; 52/242

[58] Field of Search ..... 52/241, 242, 220, 221, 52/290, 240; 160/351

[56] References Cited

U.S. PATENT DOCUMENTS

| | | | |
|---|---|---|---|
| 3,217,452 | 11/1965 | Steele | 52/242 |
| 3,386,216 | 6/1968 | Zwickert | 52/242 X |
| 3,393,484 | 7/1968 | Dunnington | 52/242 X |

*Primary Examiner*—Ernest R. Purser
*Assistant Examiner*—Carl D. Friedman
*Attorney, Agent, or Firm*—Emory L. Groff, Jr.

[57] ABSTRACT

A wiring raceway assembly comprises a single longitudinally extending member readily attached to the elevated bottom edge of a structural wall or partition member and to which are attached, by integral snap-fitting means, a raceway framing member and two covers. The framing member defines an inverted T-shaped configuration and provides two wiring trays separated by a central web while each cover includes integral hanger means on its inner surface engageable with the framing member to support and retain the lower portion of the cover in abutment with the framing member.

11 Claims, 3 Drawing Figures

PARTITION RACEWAY

This invention relates generally to partitions or panels of the well known type employed to subdivide a large enclosure into a plurality of smaller areas, and more particularly, to the provision of an improved raceway for such partitions offering readily accessible means for the installation and concealment of utility or service cables such as electrical wires or telephone cables.

Many efforts have been made to offer convenient means associated with movable or semi-permanently installed partition assemblies to provide these electrical raceways, yet many of these prior attempts require extensive modification of the partition itself and/or incorporate a multitude of complicated components resulting in a rather expensive assembly.

By the present invention an improved arrangement is provided comprising a plurality of relatively inexpensive components, preferably of non-metallic composition, which may be quickly fitted to many existing partition assemblies without the need for any special tools and whereby two separate wiring channels separated by a central divider are offered, each normally totally enclosed by a snap-fitting cover substantially co-planar with the outer surface of the attached panel.

Several advantages accrue by forming the various components of the present invention from a non-metallic composition such as Vinyl plastic. First, all of the components may be formed by extrusion means, thus producing an economical manner of fabrication. Also, the inherent resilience or flexibility thereof permits the formation of a snap-fitting assembly of the various components. The naturally quiet operation of movable plastic members is a further advantage as is also the insulative property of the components in an electrical wiring environment.

Accordingly, one of the objects of the present invention is to provide an improved partition raceway including a central framing member of inverted T-shape configuration suspended from the bottom of a partition and adapted to hingedly support at either side a removable cover having releasable attachment means adjacent its top for retaining the cover in a normal use position essentially co-planar with the outer surface of the partition.

A further object of the present invention is to provide an improved partition raceway including a top mounting member secured to the bottom of a partition and provided with releasable snap-fitting means for the removable attachment of a central framing member and a pair of covers.

A further object of the present invention is to provide an improved partition raceway comprising a plurality of components, all of which are constructed of a synthetic resinous composition and which are releasably snap fitted to one another without the inclusion of disparate fastener elements.

Still another object of the present invention is to provide an improved partition raceway for use in an assembly of two or more adjacently connected partitions joined by a post assembly, and wherein each partition is provided with a raceway framing and mounting member terminating short of the connecting post assembly while a raceway cover encloses each side of the framing member and includes an end edge extending longitudinally beyond the end of the juxtaposed framing and mounting members and abutting the end edge of a longitudinally adjacent cover to provide a smooth continuous cover along the bottom of the assembly of partitions.

With these and other objects in view, which will more readily appear as the nature of the invention is better understood, the invention consists in the novel construction, combination and arrangement of parts hereinafter more fully described, illustrated and claimed.

Similar reference characters designated corresponding parts throughout the several figures of the drawing.

Figure 1:
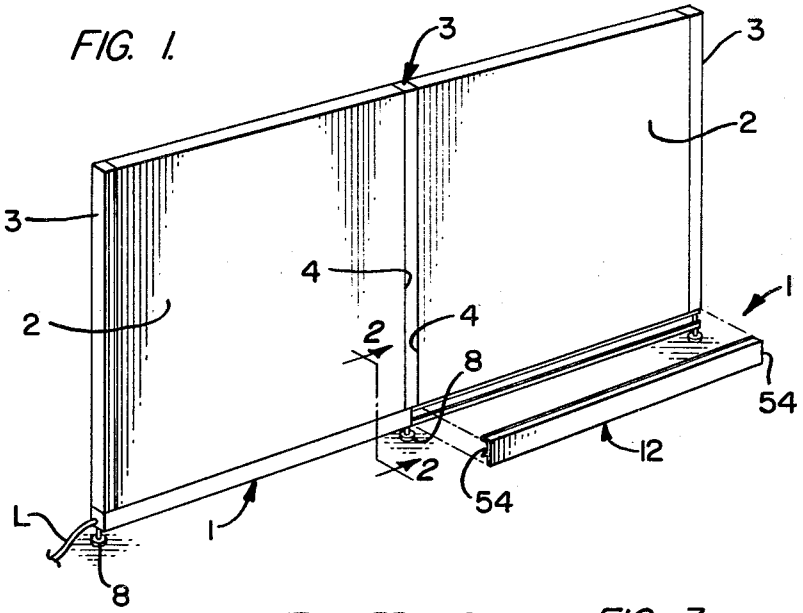
FIG. 1 is a perspective view illustrating the raceway of the present invention associated with an exemplary partition assembly.

Referring now to the drawing, particularly FIG. 1, the present invention will be seen to comprise a raceway or wiring access assembly generally designated 1, and which is intended to be incorporated along the horizontal extent of the bottom of a vertically disposed partition or panel 2. Office partitions as such are quite well known and it will be understood that the raceway 1 of the present invention may be combined with any of numerous types presently available and the specific construction of the partition is generally immaterial insofar as the raceway is concerned. Most partitions 2 are intended to be combined in series to produce a horizontally extending partition assembly of the required length and in this respect, those well skilled in this art will appreciate that any suitable post assembly, generally designated 3, is usually employed to connect the juxtaposed edges 4—4 of a pair of partitions 2. The partitions are intended to be utilized with the bottom edge 5 thereof spaced above the floor or stationary supporting surface 6 such that an intervening space or clearance 7 is provided and often this elevated disposition of the partition is achieved by the use of support means, such as the glide 8, usually attached to the bottom of the post assembly 3 by means of an adjusting screw 9.

Figure 3:
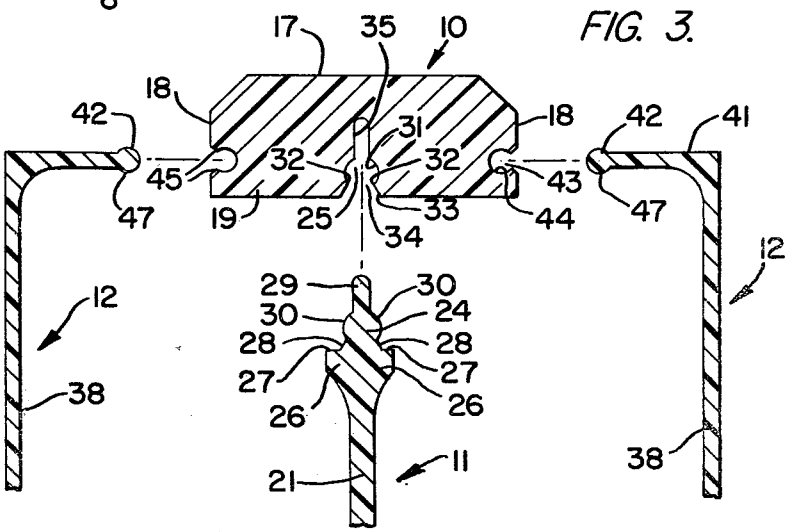
FIG. 3 is an exploded partial transverse sectional view illustrating the snap-fit attachment means of the components of the instant partition raceway.
Figure 2:
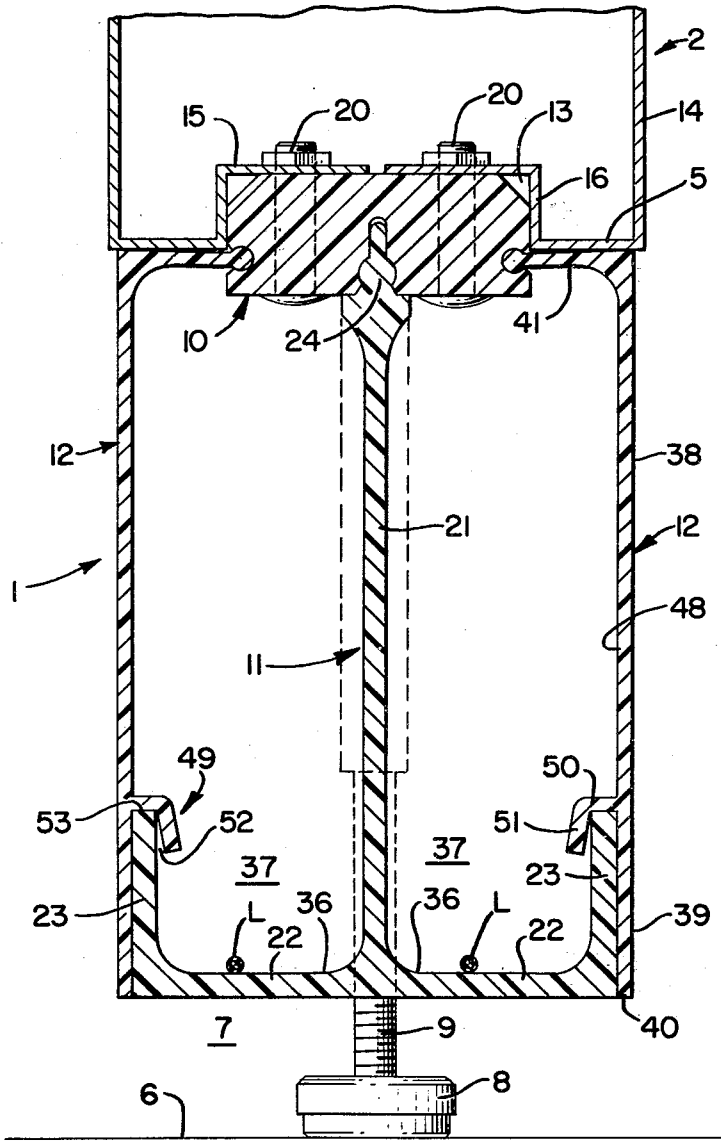
FIG. 2 is an enlarged transverse sectional view taken along the line 2—2 of FIG. 1.

The details of the raceway assembly 1 will be most readily apparent from a review of FIGS. 2 and 3 of the drawing wherein it will be seen that the assembly comprises three separate components — namely, a top mounting member 10, a raceway framing member 11 and a pair of covers or aprons 12—12. Preferably all of these components are fabricated from a synthetic resinous composition such as Vinyl plastic for reasons which will become obvious hereinafter.

The top mounting member 10 comprises a longitudinally extending element of an overall length which is no greater than the distance between the two panel edges 4—4 of the partition 2. This mounting member 10 wil be understood to serve as the sole means for supporting the entire raceway assembly 1 beneath the bottom wall 5 of a partition 2. In the illustration of FIG. 2 of the drawing, the bottom of the partition 2 is shown with a bottom channel 13 formed therein spaced inwardly from the outer surface 14 of the panel and bounded by a top wall 15 and a pair of side walls 16—16. Many panels presently on the market are provided with a channel such as the channel 13 extending about all four peripheral edges of the panel and which is utilized on the sides of the panel for the reception of the attaching means intended to cooperate with the post assembly 3, while an appropriate trim strip or cap is usually applied within the channel along the top of the partition. However, a feature of the instant invention includes the readiness with which the present raceway assembly 1 may be retro-fitted to existing partitions of various configurations, and accordingly it will be understood that the provision of the bottom channel 13 is not critical for the practice of the present invention.

The top mounting member 10 includes a top surface 17 and a pair of side surfaces 18 in turn connected to a bottom surface 19. This mounting member 10 is fixedly attached to the bottom of the partition 2 by any suitable means such as by the fastener elements 20 shown in FIG. 2 of the drawing, and in this particular installation it will be seen that the top member 10 is constructed to provide a close fit within the bottom channel 13. As mentioned above, the top mounting member 10 serves as the sole supporting means for the remaining components of the raceway assembly 1 and included among these remaining components is the raceway framing member 11 comprising a longitudinally extending member having an overall length substantially identical to that of the top mounting member 10 and which will be seen to define a substantially inverted T-shaped configuration comprising a central vertical web 21 from which extend laterally a pair of bottom walls 22 which in turn are connected to the vertically disposed side walls 23—23. Means for positively connecting the framing member 11 to the top mounting member 10 include snap-fitting attachment means comprising a ball or bead 24 adjacent the upper extremity of the framing member 11 and a socket 25 centrally formed in the top mounting member 10 adjacent its bottom surface 19.

The body of the upper portion of the framing member central vertical web 21 will be seen to be enlarged to provide the laterally extending portions 26 beneath the ball 24 with the upper portion of these lateral extensions 26 forming a stop wall 27 which in turn communicates with the inclined shoulders 28, as shown most clearly in FIG. 3 of the drawing. The ball 24 includes a tongue or pilot 29 projecting upwardly therefrom and forming the distal portion of the top of the framing member 11. With this construction in mind, the ball 24 will thus offer a pair of laterally exposed curved peripheral segments 30—30, the lateral extension or diameter of which is greater than the lateral extent of the two shoulders 28—28.

The foregoing described structure is intended to cooperate with the socket 25 formed in the top mounting member 10, which socket includes a pair of curved peripheral segments 31—31 each terminating at their lower portions to provide a lip 32 defining a relatively sharp edge with the outwardly extending chamfers 33. The lateral extent between the two opposed lips 32—32 is obviously substantially less than the lateral extent or diameter between the widest portion of the curved peripheral segments 31—31, and it is the resulting restricted throat 34 that will be understood to be responsible for the snap-fitting attachment of the framing member 11 to the top mounting member 10.

Extending upwardly from the socket 25 is a vertically disposed pilot passageway 35 into which the tongue or pilot 29 of the framing member enters when the two components are assembled as shown in the view of FIG. 2 of the drawing. During the formation of the top mounting member 10 and framing member 11, the diameter of the ball 24 is constructed slightly less than the diameter of the socket 25 and likewise the lateral extent between the opposed lips 32—32 is formed slightly greater than the lateral extent between the upper portion of the two shoulders 28—28 of the framing member, so that there is no binding or distortion of either of the two components when they are snap-fitted into the assembled position, yet a firmly seated mating of the components is assured since the lateral extent between the two top mounting member lips 32—32 is substantially less than the diameter or lateral extent of the widest portion of the ball 24. By the above described construction, it will be appreciated that a firm seating is achieved as the restricted throat 34 of the top mounting member engages the framing member and the shoulders 28 and lateral extension 26 thereof seat against the chamfers 33 and bottom surface 19 of the top mounting member 10. The foregoing snap-fitting attachment is greatly facilitated by the selection of an appropriate composition for the components, and it has been found that rigid Vinyl plastic having a durometer of 95 on the Shore "A" scale adequately provides the appropriate degree of resilience for achieving the described attachment. Further stability between these assembled components is provided by the longitudinal extension of the close fitting tongue 29 and the lateral bracing afforded by the widened contact area of the stop walls 27—27.

With the framing member 11 thus attached to the bottom of a partition 2, the desired electrical or utility service lines L may be placed upon the floor 36 of either or both of the wiring channels or trays 37 formed by the central web 21, bottom walls 22 and side walls 23 of the framing member. After thus positioning the wiring the covers 12 are installed.

Each cover will be seen to comprise a planar main side wall 38 including a lower portion forming a depending skirt 39 terminating in a lower edge 40. The upper portion of the cover includes a top flange 41 extending inwardly from the main side wall 38 and includes a longitudinally extending ball or bead 42 at its extremity. This ball 42 provides half of the snap-fitting attachment means for securing the covers 12 with respect to the top mounting member 10 and each ball 42 is intended to cooperate with a longitudinally extending socket 43 formed in the side surface 18 of the top mounting member 10. This socket 43 includes a circular peripheral surface 44 describing substantially greater than 180°. As in the case of the socket 25 forming a portion of the snap-fitting attachment means for the framing member 11, the socket 43 likewise is bounded by a pair of lips 45—45 spaced apart from one another a distance which is substantially less than the diameter of the circular socket surface 44. The two lips 45—45 are spaced inwardly from the top mounting member side surface 18 and joined thereto by the outwardly extending chamfers 46—46. Like the ball-socket attachment of the framing member 11, the curved or circular periphery 47 of the cover ball 42 defines a diameter slightly less than that of the socket 43, yet substantially greater than the distance between the lips 45—45 to ensure a positive snap-fitting connection therebetween without any subsequent binding when in the installed position of FIG. 2 of the drawing.

To preclude sagging of the main side wall 38 of the cover away from the bottom edge 5 of the partition 2 and to ensure a close surface abutment between the skirt 39 and the framing member side wall 23, the cover 12 is provided on its inner surface 48 with support and retaining means comprising a hanger arm, generally designated 49, and which will be seen to include an inwardly directed portion 50 terminating in an inclined depending portion 51 to form a tapered space 52 therebetween. The hanger arm thus serves as a saddle support for the cover 12 and in view of the close fit of the side wall top edge 53 within the upper reaches of the space 52, the skirt 39 is positively supported and retained in close abutment with the outer surface of the framing member side walls 23. By forming the depending portion 51 of the hanger arm 49 at a slight inclination away from the inner surface 48 of the cover 12, the top flange 41 of the cover upper portion is readily moved away from the top mounting member 10 upon disengagement of the ball 42 from the socket 43, whereafter the cover is readily elevated and easily removed completely from the balance of the raceway assembly. Re-attachment of the cover is simply achieved with the operator merely lowering the hanger means 49 over the top edge 53 of the framing member side wall 23, after which the ball 42 of the cover is snap-fitted into its respective socket 43. The limited resilience of the material forming the various components allows of a slight deflection of the normally vertical disposition of the cover side wall 38 during its attachment and removal as the upper portion thereof pivots about the top edge 53 of the framing member side wall 23. In this respect it will be noted that the thickness of the elements forming the framing member is greater than the elements of the cover 12, thus minimizing any deflection of the framing member 11 while permitting of slight deflection of the cover during its manipulation.

As previously described, the top mounting member 10 and framing member 11 are initially provided so that their distal portions do not extend beyond the respective edges 4—4 of the partition 2, yet when a plurality of partitions 2 are assembled to one another by means of appropriate post assemblies 3, it will be obvious that a space would then exist between juxtaposed panel edges 4 and the respective mounting members 10 and framing members 11. To completely mask all wiring or other utility service lines extending from the wiring channel 37 beneath one partition to the wiring channel 37 of the next adjacent partition, it is proposed to form the raceway cover 12 of a longitudinal extent sufficient to ensure that the end edges 54 thereof project beyond their respective partition edges 4 to flushly abut one another and form a smooth, continuous or uninterrupted enclosure for the entire raceway assembly.

I claim:

1. A wiring raceway for a partition assembly including, a partition having outer surfaces and a bottom edge elevated above a supporting surface to provide a clearance therebetween, said raceway including a top mounting member rigidly affixed to said partition bottom edge, said top mounting member of a transverse dimension substantially less than that of said partition and having side surfaces spaced inwardly from said partition outer surfaces and extending downwardly beneath said partition bottom edge, said top mounting member provided with a bottom surface having attachment means medially disposed therein, attachment means on said side surfaces beneath said bottom edge, a framing member having a vertical web connectable to said mounting member and depending therefrom, said web including attachment means on its upper portion mating with said mounting member attachment means to provide releaseable connection therebetween whereby, said framing member is supported in a suspended manner from said mounting member, a bottom wall extending laterally from said vertical web and freely disposed above said supporting surface, a side wall vertically extending from the free end of said bottom wall to define with said bottom wall and said web a wiring channel, a cover having a side wall normally substantially coplanar with one said partition outer surface and including an upper portion extending inwardly beneath said partition bottom edge and provided with attachment means removably engageable with said mounting member side surface attachment means, and said cover includes a lower portion provided with hanger means engageable with said framing member side wall to pivotally support and retain said cover lower portion juxtaposed said framing member side wall whereby, said cover fully encloses said wiring channel from said side wall to said partition bottom edge.

2. A wiring raceway according to claim 1 wherein, said framing member includes a pair of said bottom walls one extending laterally from either side of the lower portion of said web, one said side wall vertically extending from both said bottom walls to define a pair of said wiring channels separated by said framing member web, and a separate one of said covers fully encloses each said wiring channel.

3. A wiring raceway according to claim 1 wherein, said mounting member, framing member and cover are fabricated from Vinyl plastic.

4. A wiring raceway according to claim 1 wherein, said cover side wall extends vertically from said framing member side wall to substantially said partition bottom edge.

5. A wiring raceway according to claim 1 wherein, said hanger means includes an arm integral with the inner surface of said cover side wall and provided with an inwardly directed portion having an angularly depending portion.

6. A wiring raceway according to claim 1 wherein, said partition assembly includes a pair of said partitions having lateral edges disposed in opposition, a post assembly intermediate and connected to said opposed partition edges, support means affixed to the lower portion of said post assembly maintaining said partition assembly in said elevated disposition, said raceway mounting member and framing member attached to said two partitions extending longitudinally no further than said respective partition lateral edges and said covers having end edges longitudinally extending beyond their respective mounting members and framing members and terminating beneath said post assembly to partially mask said support means.

7. A wiring raceway according to claim 6 wherein, said support means includes a screw having a glide attached to its bottom.

8. A wiring raceway according to claim 1 wherein, said attachment means on said web and top mounting member bottom surface comprise snap-fitting components.

9. A wiring raceway according to claim 8 wherein, said snap-fitting components include a ball configuration on said web cooperating with a socket in said mounting member.

10. A wiring raceway according to claim 1 wherein, said attachment means on said cover and top member side surface comprise snap-fitting components.

11. A wiring raceway according to claim 5 wherein, said snap-fitting components include a ball configuration on said cover upper portion cooperating with a socket in said mounting member.

* * * * *